US007780287B2

(12) United States Patent
Yamagata et al.

(10) Patent No.: US 7,780,287 B2
(45) Date of Patent: Aug. 24, 2010

(54) PRINTING METHOD AND PRINTER

(75) Inventors: Yasuhiro Yamagata, Shiojiri (JP); Kunio Omura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 687 days.

(21) Appl. No.: 11/704,542

(22) Filed: Feb. 8, 2007

(65) Prior Publication Data

US 2007/0182804 A1 Aug. 9, 2007

(30) Foreign Application Priority Data

Feb. 9, 2006 (JP) ..... 2006-031995

(51) Int. Cl.
*B41J 2/01* (2006.01)

(52) U.S. Cl. ..... 347/107

(58) Field of Classification Search ..... 347/107
See application file for complete search history.

(56) References Cited

U.S. PATENT DOCUMENTS 6,032,863 A * 3/2000 Nethery, III ..... 235/462.07
6,236,752 B1 5/2001 Katayama et al.
6,481,816 B1 * 11/2002 Oyen ..... 347/12
2003/0048460 A1 * 3/2003 Vinals-Matas et al. ..... 358/1.8

FOREIGN PATENT DOCUMENTS

| | | |
|---|---|---|
| JP | 08-150374 | 6/1996 |
| JP | 10-86452 | 4/1998 |
| JP | 11-221929 | 8/1999 |
| JP | 11-226930 | 8/1999 |
| JP | 2003-145734 | 5/2003 |

* cited by examiner

*Primary Examiner*—Julian D Huffman
(74) *Attorney, Agent, or Firm*—Nutter McClennen & Fish LLP; John J. Penny, Jr.; Rory P. Pheiffer

(57) ABSTRACT

A printing method for printing a barcode forms a plurality of dots on a print medium from one end of the bars to the other end by discharging ink droplets from print nozzles assigned to print the bars from among a plurality of nozzles aligned in a direction intersecting the bars. The printing method divides the barcode in the direction of the length of the bars into a plurality of segments, changes which of the plural nozzles are assigned as print nozzles in each of the segments, and discharges ink from the print nozzles in each of the segments to print the barcode.

6 Claims, 7 Drawing Sheets

| BITMAP DATA | | | | | | | | | |
|---|---|---|---|---|---|---|---|---|---|
| COLUMN No. / ROW No. | 1 | 2 | 3 | 4 | 5 | 6 | 7 | 8 | 9 |
| 1 | 1 | 1 | 1 | 1 | 1 | 1 | 1 | 1 | 1 |
| 2 | 0 | 0 | 0 | 0 | 0 | 0 | 0 | 0 | 0 |
| 3 | 0 | 0 | 0 | 0 | 0 | 0 | 0 | 0 | 0 |
| 4 | 1 | 1 | 1 | 1 | 1 | 1 | 1 | 1 | 1 |
| 5 | 1 | 1 | 1 | 1 | 1 | 1 | 1 | 1 | 1 |
| 6 | 0 | 0 | 0 | 0 | 0 | 0 | 0 | 0 | 0 |
| 7 | 0 | 0 | 0 | 0 | 0 | 0 | 0 | 0 | 0 |
| 8 | 1 | 1 | 1 | 1 | 1 | 1 | 1 | 1 | 1 |
| 9 | 0 | 0 | 0 | 0 | 0 | 0 | 0 | 0 | 0 |
| 10 | 0 | 0 | 0 | 0 | 0 | 0 | 0 | 0 | 0 |
| 11 | 1 | 1 | 1 | 1 | 1 | 1 | 1 | 1 | 1 |
| 12 | 1 | 1 | 1 | 1 | 1 | 1 | 1 | 1 | 1 |
| 13 | 0 | 0 | 0 | 0 | 0 | 0 | 0 | 0 | 0 |
| 14 | 0 | 0 | 0 | 0 | 0 | 0 | 0 | 0 | 0 |
| 15 | 1 | 1 | 1 | 1 | 1 | 1 | 1 | 1 | 1 |
| ... | ... | ... | ... | ... | ... | ... | ... | ... | ... |
| 180 | 1 | 1 | 1 | 1 | 1 | 1 | 1 | 1 | 1 |

Y

X

| CONVERTED BITMAP DATA | | | | | | | | | |
|---|---|---|---|---|---|---|---|---|---|
| COLUMN No. / ROW No. | 1 | 2 | 3 | 4 | 5 | 6 | 7 | 8 | 9 |
| 1 | 1 | 1 | 1 | 0 | 0 | 0 | 0 | 0 | 0 |
| 2 | 0 | 0 | 0 | 1 | 1 | 1 | 0 | 0 | 0 |
| 3 | 0 | 0 | 0 | 0 | 0 | 0 | 1 | 1 | 1 |
| 4 | 1 | 1 | 1 | 0 | 0 | 0 | 0 | 0 | 0 |
| 5 | 1 | 1 | 1 | 1 | 1 | 1 | 0 | 0 | 0 |
| 6 | 0 | 0 | 0 | 1 | 1 | 1 | 1 | 1 | 1 |
| 7 | 0 | 0 | 0 | 0 | 0 | 0 | 1 | 1 | 1 |
| 8 | 1 | 1 | 1 | 0 | 0 | 0 | 0 | 0 | 0 |
| 9 | 0 | 0 | 0 | 1 | 1 | 1 | 0 | 0 | 0 |
| 10 | 0 | 0 | 0 | 0 | 0 | 0 | 1 | 1 | 1 |
| 11 | 1 | 1 | 1 | 0 | 0 | 0 | 0 | 0 | 0 |
| 12 | 1 | 1 | 1 | 1 | 1 | 1 | 0 | 0 | 0 |
| 13 | 0 | 0 | 0 | 1 | 1 | 1 | 1 | 1 | 1 |
| 14 | 0 | 0 | 0 | 0 | 0 | 0 | 1 | 1 | 1 |
| 15 | 1 | 1 | 1 | 0 | 0 | 0 | 0 | 0 | 0 |
| ⋮ | ⋮ | ⋮ | ⋮ | 1 | 1 | 1 | 0 | 0 | 0 |
| | | | | | | | 1 | 1 | 1 |
| 180 | 1 | 1 | 1 | ⋮ | ⋮ | ⋮ | ⋮ | ⋮ | ⋮ |
| | | | | 1 | 1 | 1 | ⋮ | ⋮ | ⋮ |
| | | | | | | | 1 | 1 | 1 |

PRINTING METHOD AND PRINTER

The present application claims priority under 35 U.S.C. §119 to Japanese Application No. JP 2006-031995 filed on Feb. 9, 2006, which is hereby incorporated by reference in its entirety.

BACKGROUND OF THE INVENTION

1. Technical Field

The present invention relates generally to a printing method and a printing device, and relates more particularly to a printing method and printing device for printing on a print medium by discharging ink droplets from nozzles.

2. Related Art

Printers that print to a print medium by discharging ink droplets from nozzles and that include scanner for reading a non-discharge detection pattern (test pattern) are known from the literature. Non-firing nozzles that cannot discharge ink are determined from the non-discharge detection pattern that is read by the scanner, and if anon-firing nozzle overlaps the barcode printing position, the barcode is printed by shifting the barcode printing position or rotating the barcode 90 degrees in order to prevent barcode reading errors. See, for example, Japanese Unexamined Patent Appl. Pub. JP-A-2003-145734.

The technology described in Japanese Unexamined Patent Appl. Pub. JP-A-2003-145734 requires printing a non-discharge detection pattern, reading this printed non-discharge detection pattern with a scanner, identifying the non-firing nozzles from the scanned non-discharge detection pattern, determining if the non-firing nozzles overlap the barcode printing position, and calculating the appropriate barcode printing position accordingly. The printing process is thus complicated by the need to confirm the print quality and adjust the barcode printing position to an appropriate position based on the determined print quality.

This related art technology also requires a scanner to read the non-discharge detection pattern and consumes print media and ink in order to print the non-discharge detection pattern. Therefore, costs increase accordingly.

Accordingly, an unresolved problem with the related art taught in Japanese Unexamined Patent Appl. Pub. JP-A-2003-145734 is that simplifying the printing process and reducing cost is difficult.

SUMMARY

The printing method and printer according to the present invention simplify the printing process and reduce costs while making it easier to avoid barcode reading errors.

A printing method according to a first embodiment of the invention prints barcodes by forming a plurality of dots on a print medium from one end to the other end of the barcode bars by discharging ink droplets from print nozzles that are selected from among a plurality of nozzles aligned in a direction intersecting the bars of the barcode and are used for printing the bars in the barcode. The printing method has steps of: dividing the length of the bars of the barcode into a plurality of segments; changing the plurality of nozzles that are used as the print nozzles in each segment; and printing a barcode by discharging the ink droplets from the print nozzles in each segment.

With this first embodiment of the invention, the length of the bars of the barcode are divided into plural segments, and the print nozzles of an array of plural nozzles aligned in a direction intersecting the bars that are used to print the bars are changed in each of the segments to print a single barcode. More specifically, this printing method of the first embodiment prints a single bar using different print nozzles in each of the segments. Therefore, even if no ink droplets are discharged from a particular print nozzle in one segment, the bar can be printed in this next segment if ink droplets are discharged from the print nozzle assigned to the same bar in the next segment.

Therefore, in the first embodiment, the likelihood that a bar will not be printed in all segments can thus be reduced, increased cost and complexity in the printing process can be reduced, and barcode reading errors can be more easily avoided without verifying the discharge state of ink droplets from the nozzles.

Preferably, in the first embodiment, the print nozzles that are used are changed by reassigning the print nozzles so that the bars in the segment at one end of the bars are shifted a predetermined direction relative to the bars in the segment at the other end of the bars.

By thus printing the bars in the first embodiment so that the bars in the segment at one end of the bars are shifted a predetermined direction from the bars in the segment at the other end of the bars, all bars in a particular segment will be shifted in the same direction. More particularly, a regular order can be imparted to the direction in which the bars are shifted in each segment within a single barcode. The segments within a single barcode can therefore be easily discerned visually, and the barcode reader can be more easily aligned with each segment.

Yet further preferably, in the first embodiment, the predetermined direction in which the bars are shifted is towards the least significant digit of the information represented by the barcode when the barcode is seen from the front.

The bars in the segment at the other end of the bars in the first embodiment are thus shifted relative to the bars in the segment at the one end of the bars towards the least significant digit of the information encoded in the barcode when the barcode is seen from the front in the normal orientation. The beginning of the barcode can thus be easily determined when the barcode printed on the print medium is viewed from the front, and the barcode reader can be easily aligned with each segment.

Yet further preferably, in the first embodiment, the nozzles that are offset a predetermined number of nozzles from the print nozzles are assigned as the new print nozzles in order to change the print nozzles that are used.

In the first embodiment, the bars in the segment at the other end of the bars are thus printed offset from the bars in the segment at the one end of the bars by a distance equal to a specific multiple of the gap between each nozzle in the array of plural nozzles, which is a distance equal to a specific multiple of the print resolution in the direction in which the plural nozzles are arrayed. A single barcode can thus be printed so that the offset between the bars in any two adjacent segments is uniform. The segments of any single barcode can thus be easily visually discerned, and the barcode reader can be easily aligned with each segment.

Yet further preferably, in the first embodiment, the predetermined number of nozzles is one.

In the first embodiment, the bars in the segment at the other end of the bars are thus printed offset from the bars in the segment at the one end of the bars by a distance equal to the gap between each nozzle in the array of plural nozzles, which is a equal to the print resolution in the direction in which the plural nozzles are arrayed. The likelihood of accurately reading the information encoded in the barcode in each segment can thus be improved without moving the barcode reader in each segment in the direction in which the bars are shifted.

A second embodiment of the invention is a printer having a nozzle array composed of a plurality of nozzles aligned in a row for discharging ink droplets to print barcodes composed of alternating bars and spaces by forming the bars by aligning a plurality of dots formed on a print medium by the ink droplets discharged from the nozzles. The printer has a data conversion means for dividing a bitmap data matrix into units of plural columns and converting the bitmap data to new bitmap data by shifting the data in each unit of plural columns in the row direction of the matrix where the bitmap data matrix represents the bars and spaces of the barcode with the matrix rows corresponding to the bar length. The matrix is equal in size to the print resolution along the length of the bars and the print resolution perpendicular to the length of the bars, and each matrix element is assigned to a particular nozzle and denotes whether the corresponding dot prints. This printer of another embodiment includes a relative motion means for moving the print medium and nozzle array relative to each other so that the print medium moves in a direction intersecting the nozzle array; and a discharge control means for discharging the ink droplets from the nozzles so that the bars extend along the direction of the relative movement based on the new bitmap data when the print medium and the nozzle array are moved relative to the other by the relative motion means.

The second embodiment of the invention converts bitmap data to new bitmap data, and assigns each bit in each column of the new bitmap data to a corresponding nozzle. Processing is thus simplified and processing time is reduced compared with a method in which the conversion occurs when printing starts and each bit in each column of the bitmap data is assigned to the particular nozzles.

In the second embodiment, the likelihood that a particular bar does not print in all segments is thus reduced, barcode reading errors can be more easily avoided, and an increase in the cost and complexity of the printing process can be suppressed without needing to verify the discharge state of ink droplets discharged from the nozzles.

Other objects and attainments together with a fuller understanding of the invention will become apparent and appreciated by referring to the following description and claims taken in conjunction with the accompanying drawings.

DESCRIPTION OF EMBODIMENTS

Figure 1A:
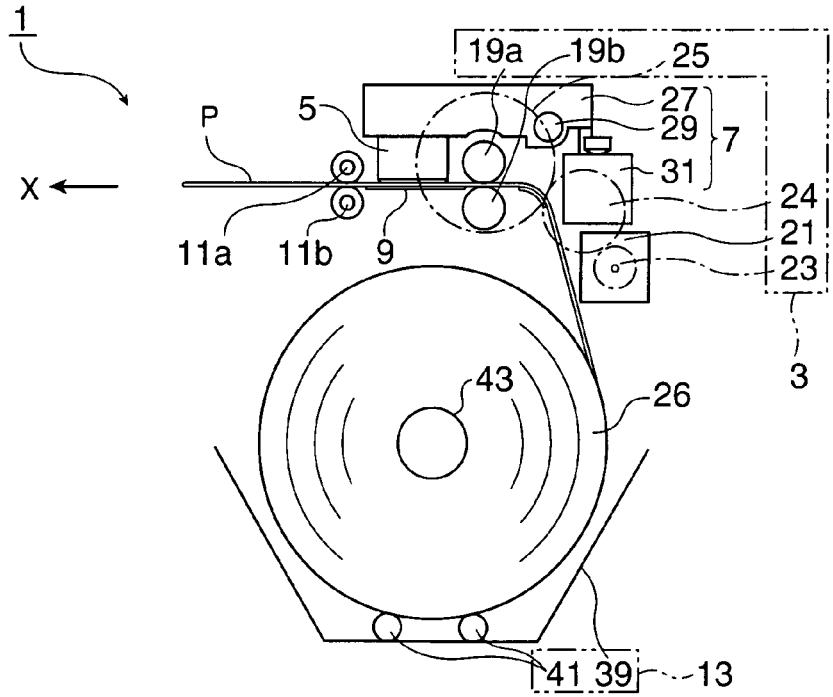
FIGS. 1A and 1B show the arrangement of a printer according to a preferred embodiment of the invention.

A printing method and printer according to a preferred embodiment of the present invention are described below with reference to the accompanying figures.

As shown in the side view in FIG. 1A and the plan view in FIG. 1B, the printer 1 according to this embodiment of the invention has a paper feed mechanism 3 for advancing the print medium P in the direction of arrow X, a print head 5 for discharging ink onto the print medium P from the nozzles described below, a head carriage mechanism 7 for moving the print head 5 bidirectionally in the direction of arrow Y, a platen 9, discharge rollers 11*a* and 11*b*, and a roll paper compartment 13. This printer 1 can therefore print on print medium P wound in a roll, that is, on roll paper.

The arrangement of these components is described further next.

As shown in FIG. 1A, the paper feed mechanism 3 has a paper feed roller 19*a* and pressure roller 19*b* disposed to rotate with the outside surfaces of these rollers touching, a paper feed motor 21 for producing the power to drive the paper feed roller 19*a* rotationally, and a first gear 23, second gear 24, and third gear 25 for transferring the power from the paper feed motor 21 to the paper feed roller 19*a*.

As seen in FIG. 1A, the paper feed roller 19*a* and pressure roller 19*b* are disposed with the paper feed roller 19*a* on the top side of the print medium P and the pressure roller 19*b* on the bottom with the print medium P disposed between the paper feed roller 19*a* and pressure roller 19*b*.

As also shown in FIG. 1A, the first gear 23, second gear 24, and third gear 25 are disposed with the first gear 23 connected to the rotating shaft of the paper feed motor 21, the second gear 24 inserted freely rotatably on a shaft disposed to a frame not shown, and the third gear 25 fit on the paper feed roller 19*a*. The first, second, and third gears 23, 24, and 25 thus render a speed reducing mechanism that amplifies and transfers the drive power from the paper feed motor 21 to the paper feed roller 19*a*.

This paper feed mechanism 3 thus transfers power from the paper feed motor 21 through the first, second, and third gears 23, 24, and 25 to the paper feed roller 19*a* to incrementally advance the print medium P held between the paper feed roller 19*a* and pressure roller 19*b* a specific distance in the direction of arrow X from the end of the paper roll 26 on which the print medium P is wound in a roll.

More specifically, when the paper feed motor 21 starts turning so that the first gear 23 rotates clockwise, the second gear 24 turns counterclockwise, and the third gear 25 turns clockwise. As a result, the paper feed roller 19*a* turns clockwise in conjunction with the third gear 25, and the print medium P advances in the direction of arrow X.

A stepping motor is used as the paper feed motor 21 in this embodiment of the invention. For legibility, the first gear 23, second gear 24, and third gear 25 are denoted by dot-dash lines in FIG. 1A.

Figure 2A:
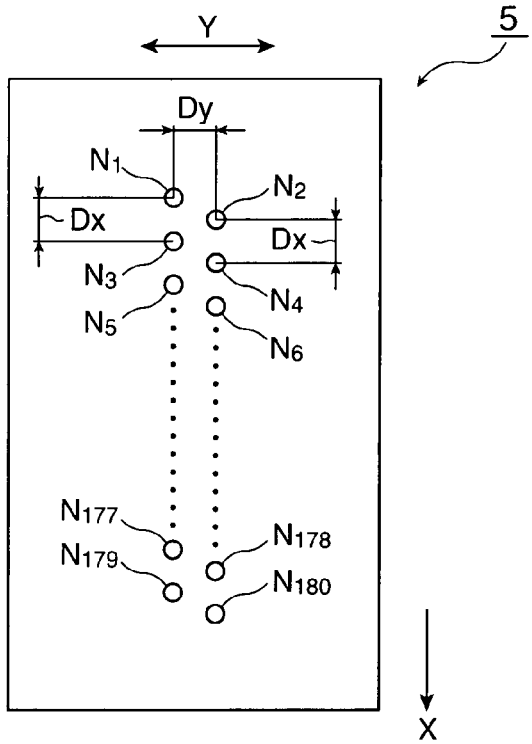
FIGS. 2A and 2B describe the arrangement of the nozzles in the print head of the printer according to the preferred embodiment of the invention.

As also shown in FIG. 1A, the print head 5 is located downstream in the direction of arrow X from the paper feed roller 19*a* and has 180 nozzles for discharging ink as ink droplets formed on the bottom face of the print head 5. As shown in FIG. 2A, the 180 nozzles arranged on the bottom face of the print head 5 are numbered from 1 to 180 with nozzle $N_1$ being the first nozzle on the upstream side in the direction of arrow X and nozzle $N_{180}$ being the last nozzle on the downstream side in the direction of arrow X.

The Y-axis position of any nozzle $N_i$ (where i is an integer from 1 to 180) differs according whether the nozzle number is even or odd. More specifically, the odd-numbered nozzles $N_i$ are arrayed on the X-axis with an interval Dx between adjacent nozzles, and the even-numbered nozzles $N_i$ are offset gap Dy on the Y-axis from the odd-numbered nozzles $N_i$ with the same interval Dx on the X-axis between adjacent even-numbered nozzles $N_i$. If the odd-numbered nozzles $N_i$ are moved parallel to the Y-axis so that the nozzles $N_1$ to $N_{180}$ are virtually aligned in a single row along the X-axis, the 180 nozzles $N_i$ render a nozzle row 17 aligned in a single column in line with the X-axis.

The gap along the X-axis between adjacent nozzles $N_i$ in the nozzle row 17 is Dx/2. This gap Dx/2 equals the distance corresponding to the printing resolution of the printer 1 in the X-axis direction. For example, if the print resolution on the X-axis is 180 dpi (dots per inch), the gap Dx/2 is approximately 0.141 mm.

Figure 2B:
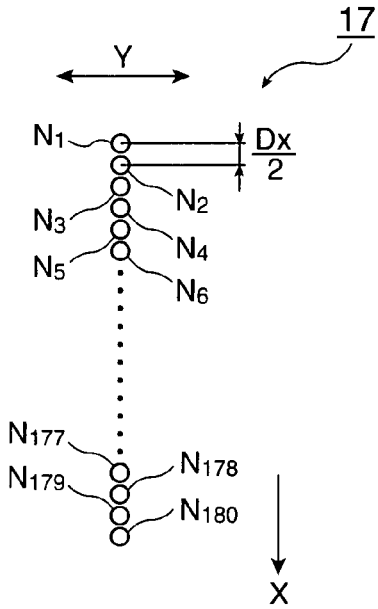

Note that the size of the nozzles $N_i$ is enlarged in FIG. 2A and FIG. 2B to show the arrangement of the nozzles $N_i$ more clearly.

As shown in FIG. 1A, the print head 5 thus arranged is disposed with the top of the print head 5 supported on a carriage 27 and the nozzle face on which the nozzles $N_i$ are formed facing the print medium P with a specific gap between the nozzle face and print medium P. More specifically, the print head 5 is supported by the carriage 27 to that the nozzle face is opposite the print medium P with a gap therebetween.

Figure 1B:
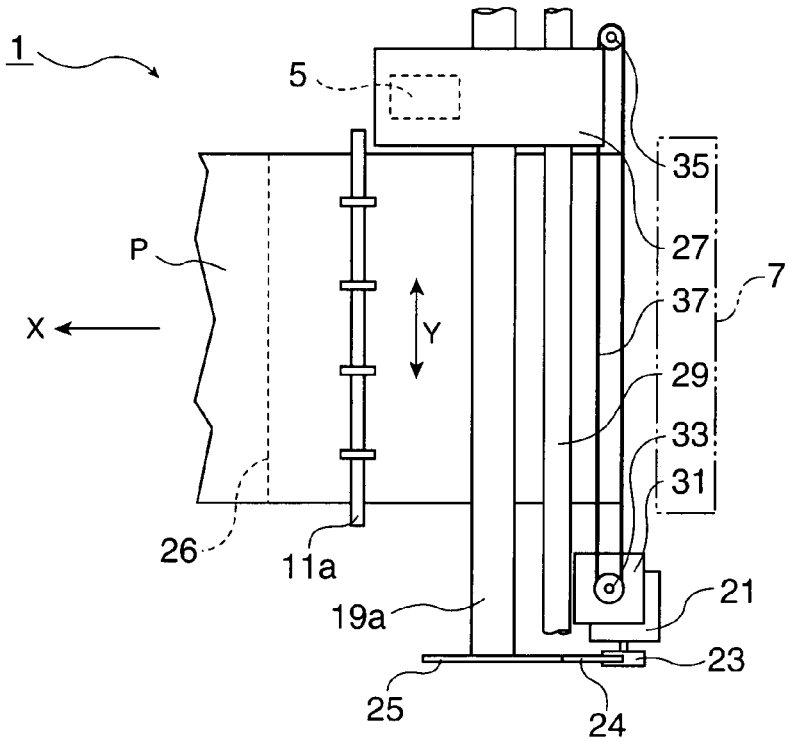

As shown in FIG. 1B the head carriage mechanism 7 has a carriage 27, a carriage shaft 29, a carriage motor 31, a motor pulley 33, a driven pulley 35, and a timing belt 37.

As seen in FIG. 1A, the carriage 27 is located above the paper feed roller 19*a* and straddles the paper feed roller 19*a* in the X-axis direction. A through-hole passing through the carriage 27 along the Y-axis is rendered in the carriage 27 on the upstream side of the paper feed roller 19*a* on the X-axis. A bearing not shown is inserted to this through-hole, and the carriage shaft 29 is inserted to this bearing so that the carriage shaft 29 turns freely. The print head 5 is disposed to the bottom of the carriage 27 at a position downstream from the paper feed roller 19*a* on the X-axis.

The carriage shaft 29 is located above the print medium P on the upstream side of the paper feed roller 19*a* on the X-axis as shown in FIG. 1A, and is supported on a frame not shown spanning the print medium P in the Y-axis direction. The carriage shaft 29 passes through the through-hole in the carriage 27 with the carriage shaft 29 supported by the bearings disposed in the through-hole in the carriage 27.

The carriage motor 31 produces the power for moving the carriage 27 on the Y-axis. As shown in FIG. 1B, the carriage motor 31 is supported on the frame not shown at a position to the outside of the print medium P where the carriage motor 31 will not interfere with print medium P travel. A stepping motor is used as the carriage motor 31 in this embodiment of the invention.

As shown in FIG. 1B, the motor pulley 33 is fit onto the rotating shaft of the carriage motor 31. As also shown in FIG. 1B, the driven pulley 35 is supported freely rotatably on the frame not shown at a position opposite the motor pulley 33 with the print medium P between the pulleys.

The timing belt 37 is disposed between the motor pulley 33 and driven pulley 35 spanning the print medium P in the Y-axis direction as shown in FIG. 1B. The carriage 27 is fixed to a part of the timing belt 37.

The motor pulley 33, driven pulley 35, and timing belt 37 transfer drive power from the carriage motor 31 to the carriage 27 affixed to the timing belt 37 while converting the direction of rotation to linear movement along the Y-axis.

The head carriage mechanism 7 thus arranged transfers power from the carriage motor 31 through the motor pulley 33, driven pulley 35, and timing belt 37 to the carriage 27, and thus moves the carriage 27 and the print head 5 mounted on the carriage 27 along the Y-axis.

This printer 1 prints on the print medium P by discharging ink droplets from nozzle $N_i$ while the print head 5 travels across the stationary print medium P. In one pass of the print head 5 across the stationary print medium P, the print head 5 can thus print a row with a maximum height equal to the length of the nozzle row 17 along the X-axis.

When the print head 5 prints the maximum row height, the paper feed mechanism 3 intermittently advances the print medium P in the X-axis direction a distance equal to the length of the nozzle row 17. More specifically, the paper feed mechanism 3 of the printer 1 advances the print medium P the distance equal to the length of the nozzle row 17 and then pauses while the print head 5 prints the maximum row height while being moved by the head carriage mechanism 7 across the print medium P on the outbound pass. The paper feed mechanism 3 then again advances the print medium P the distance equal to the length of the nozzle row 17 and pauses while the print head 5 prints the maximum row height while being moved by the head carriage mechanism 7 across the print medium P on the return pass. In the printing operation to this point, the print head 5 has crossed the print medium P twice and completed one round-trip pass on the Y-axis.

The printer 1 thus prints to the print medium P by repeating the operating sequence of advancing and pausing the print medium P, and then moving the print head 5 while printing.

As shown in FIG. 1A the platen 9 is located downstream from the pressure roller 19*b* on the X-axis and opposite the print head 5 with the print medium P therebetween. The platen 9 supports the print medium P fed between the paper feed roller 19*a* and pressure roller 19*b* downstream on the X-axis from the paper feed roller 19*a* and pressure roller 19*b*.

The discharge rollers 11*a* and 11*b* are downstream on the X-axis from the print head 5 as shown in FIG. 1A, and are disposed to rotate in unison with their outside surfaces in contact. These discharge rollers 11*a* and 11*b* are rotationally driven while holding the print medium P between the discharge rollers 11*a* and 11*b* to feed the print medium P downstream on the X-axis and discharge the print medium P from the printer 1.

When the print medium P is held between the pair of discharge rollers 11*a* and 11*b* after being fed between the paper feed roller 19*a* and pressure roller 19*b* in the X-axis direction, the portion of the print medium P that is supported by the platen 9 is flat.

The roll paper compartment 13 as shown in FIG. 1A has a storage container 39 and rollers 41. The storage container 39 holds a paper roll 26 formed by rolling the print medium P into a roll. The rollers 41 are disposed to rotate freely on the bottom of the storage container 39 and support the paper roll 26 so that the outside of the paper roll 26 rotates freely on the rollers 41.

As shown in FIG. 1A the print medium P is wound onto a hollow core 43 to form the paper roll 26. Printers that print to roll paper generally use a spindle loading method or a drop-in loading method. With the spindle loading method a spindle is passed through the core 43 so that the paper roll 26 is supported and can rotate freely on the spindle. With the drop-in method the outside surface of the paper roll 26 is supported so that the paper roll 26 can rotate freely, and a spindle is not passed through the core 43. The drop-in method is therefore preferable to the spindle loading method because there is no need to pass a spindle through the core 43 and the roller can therefore be replaced more quickly and easily. The printer 1 according to this embodiment of the invention uses the drop-in loading method. In the drop-in loading method the rollers 41 help the paper roll 26 rotate easily.

Figure 3:
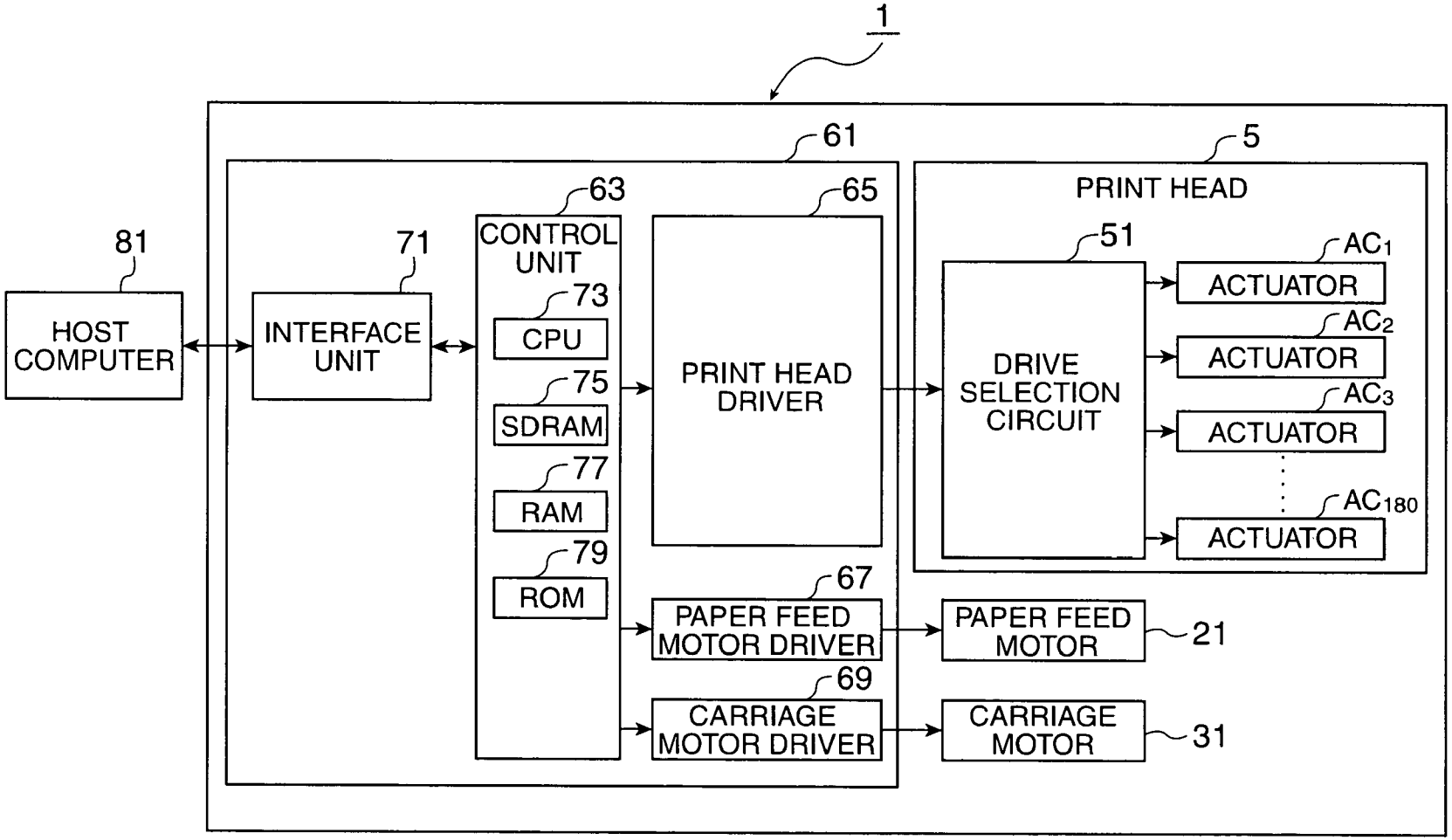
FIG. 3 is a block diagram of the print head and control circuit of the printer according to the preferred embodiment of the invention.

As shown in FIG. 3, the printer 1 has a control circuit 61 for controlling the operation of other printer parts. The control circuit 61 includes a control unit 63, a print head driver 65, a paper feed motor driver 67, a carriage motor driver 69, and an interface unit 71.

The control unit 63 is a microcomputer, for example, and includes a CPU (central processing unit) 73, SDRAM (synchronous dynamic random access memory) 75, RAM (random access memory) 77, and ROM (read-only memory) 79.

The CPU 73 runs the printing process and other processes.

The SDRAM 75 is used for storing bitmap data that is input through the interface unit 71 from a host computer 81 such as a POS (point-of-sale) system or ATM (automated teller machine), and for storing the converted bitmap data described below that is converted from the bitmap data input from the host computer 81.

The RAM 77 is temporary storage for storing data and the application program, such as a printing process, that is run by the CPU 73.

The ROM 79 is non-volatile semiconductor memory that stores the control program executed by the CPU 73.

The print head driver 65 controls the print head 5 based on commands from the CPU 73.

The paper feed motor driver 67 controls the paper feed motor 21 based on commands from the CPU 73.

The carriage motor driver 69 controls the carriage motor 31 based on commands from the CPU 73.

The interface unit 71 outputs bitmap data for the text and images received from the host computer 81 for printing, and outputs information received form the control unit 63 to the host computer 81.

As shown in FIG. 3, the print head 5 has a drive selection circuit 51 and 180 actuators $AC_1$ to $AC_{180}$ corresponding to the number of nozzles $N_i$. These 180 actuators $AC_1$ to $AC_{180}$ are assigned one per nozzle $N_i$, and the indices 1 to 180 correspond to the nozzle numbers 1 to 180.

A piezoelectric device can be used for each actuator $AC_i$. When a drive signal is applied from the print head driver 65 through the drive selection circuit 51, the actuator $AC_i$ compresses an ink chamber not shown that is filled with ink. Contraction of the ink chamber applies pressure to the ink and causes the ink to be discharged as an ink droplet from the nozzle $N_i$ communicating with the ink chamber. The discharged ink droplet forms a dot on the print medium P, and the dots are formed in groups to print.

The bitmap data for the characters and images to be printed is described next.

Figure 4C:
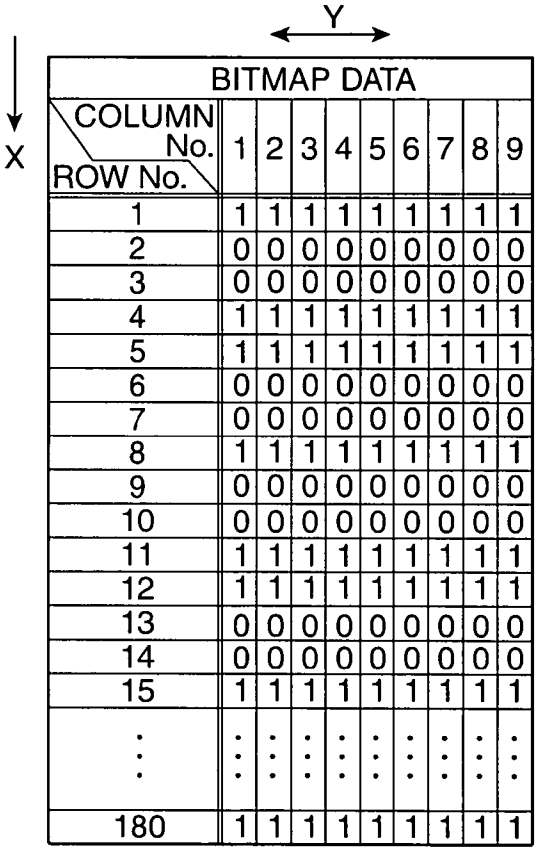
FIGS. 4A-4C describe the bitmap data of the printer according to the preferred embodiment of the invention.
Figure 4B:
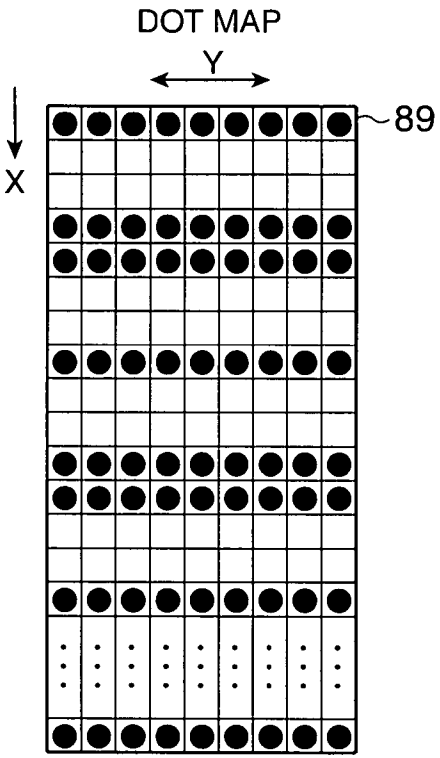
Figure 4A:
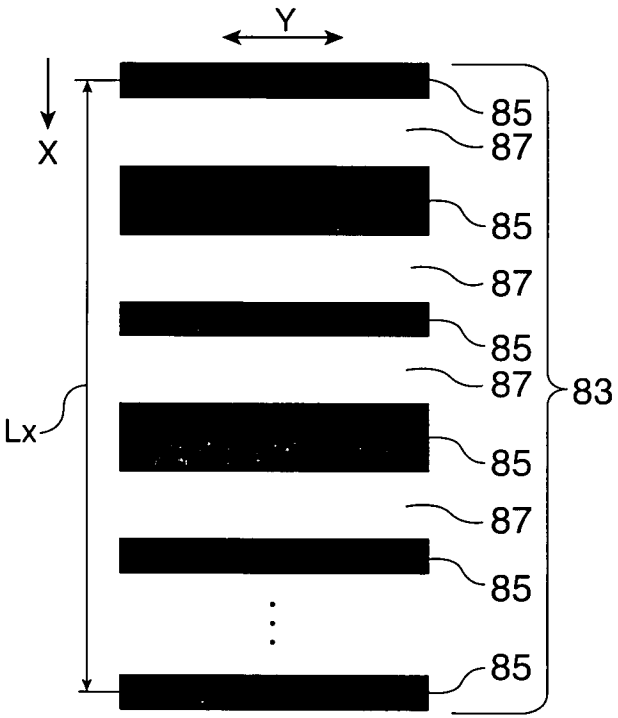

In this example the host computer 81 outputs a command for printing a barcode 83 as shown in FIG. 4A. The barcode 83 has a series of bars 85 and alternating spaces 87 arrayed over distance Lx along the X-axis. Note that while only the bars 85 and spaces 87 of the barcode 83 are shown in the figure for brevity, the barcode generally also includes a human readable interpretation of letters and symbols.

The elements of the barcode 83 are grouped by the printable pixel unit of the printer 1, and as shown in FIG. 4B, a dot map denoting whether a particular dot 89 prints or not is compiled for every pixel. Note that a print pixel corresponds to one square in the dot map matrix shown in FIG. 4B, is unrelated to the size of the dot 89, and is the smallest size of dot 89 that the printer 1 can form. If the print resolution in both the X and Y directions is 180 dpi, the print pixels are formed approximately every 0.141 mm on the X-axis and approximately every 0.141 mm on the Y-axis.

If the dots 89 in the dot map shown in FIG. 4B are assigned a logic value of 1 and the white spaces are assigned a logic value of 0, a bitmap data matrix is formed as shown in FIG. 4C with the length of the bars 85 and spaces 87 along the Y-axis arrayed in the rows and the nozzle row 17 oriented along the X-axis arrayed in the column direction. The host computer 81 generates this bitmap and inputs the bitmap through the interface unit 71 to the control unit 63.

The print head 5 and print head driver 65 are further described next.

Figure 5:
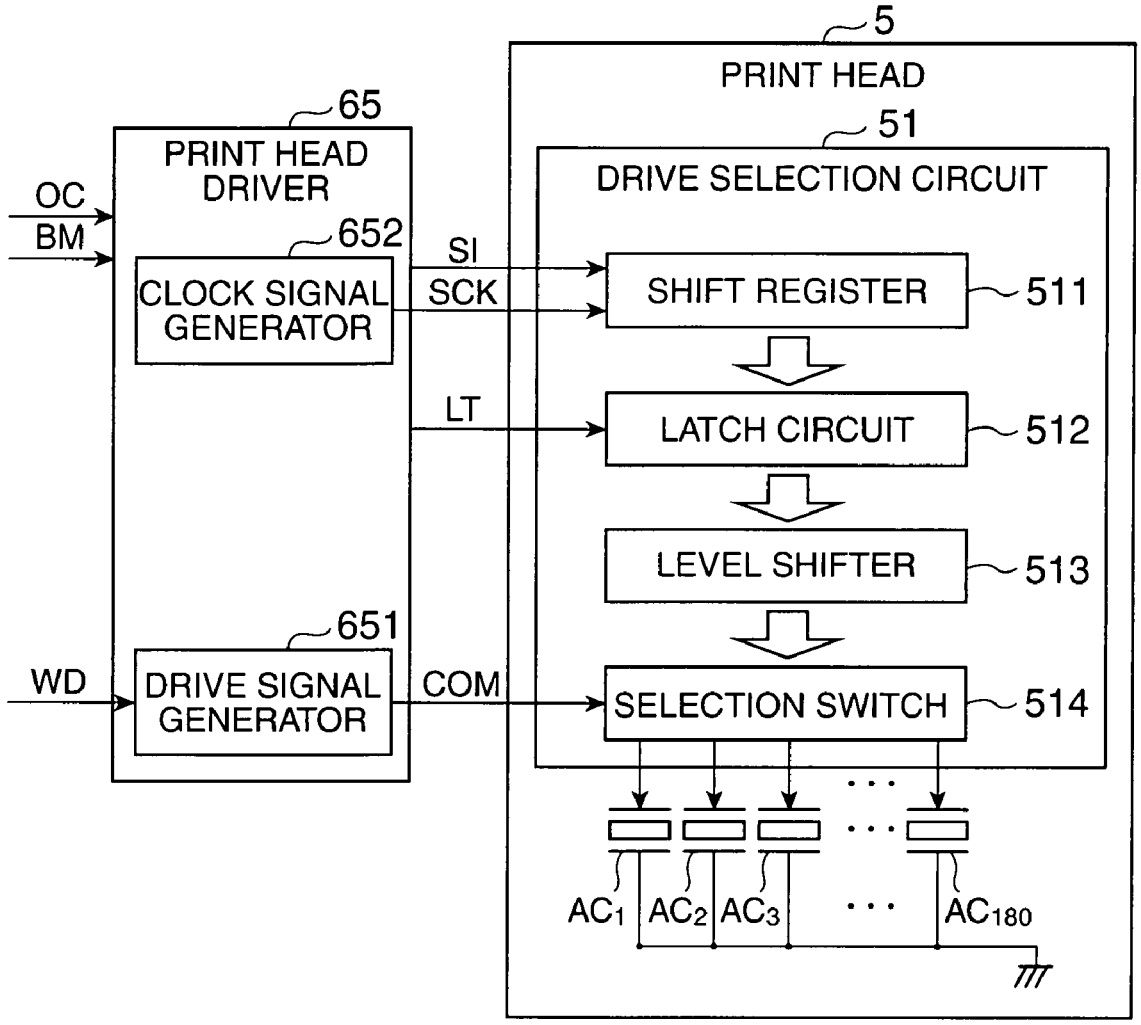
FIG. 5 describes the arrangement of the print head driver and print head of the printer according to the preferred embodiment of the invention.

The print head driver 65 has a drive signal generator 651 and a clock signal generator 652 as shown in FIG. 5.

The drive selection circuit 51 of the print head 5 has a shift register 511, a latch circuit 512, a level shifter 513, and a selection switch 514 as shown in FIG. 5.

The drive signal generator 651 generates the drive signal COM for driving the actuators $AC_i$, and outputs this drive signal COM to the drive selection circuit 51 of the print head 5. Note that the drive signal generator 651 produces the drive signal COM to a specific waveform based on the waveform data WD stored in the ROM 79.

The clock signal generator 652 generates a clock signal SCK, and outputs the clock signal SCK to the drive selection circuit 51 of the print head 5.

Print data SI that is equivalent to the data for one column in the bitmap data matrix is supplied as serial data from the print head driver 65 to the shift register 511, which stores and sequentially shifts the print data SI based on the clock signal SCK. The print data SI determines whether or not each nozzle $N_i$ discharges an ink droplet where the nozzle number i is the row number of each bit in one column of the bitmap.

More specifically, in column 1 of the bitmap table shown in FIG. 4C, the value "1" of the row 1 bit is assigned to nozzle $N_1$, the value "0" of the row 2 bit is assigned to nozzle $N_2$, the value "0" of the row 3 bit is assigned to nozzle $N_3$, the value "1" of the row 4 bit is assigned to nozzle $N_4$, and so forth until the value "1" of the row 180 bit is assigned to nozzle $N_{180}$. A nozzle $N_i$ to which a "1" bit is assigned so that the nozzle $N_i$ discharges an ink droplet is called a "print nozzle."

The print head driver 65 converts the bitmap data to the print data SI.

The latch circuit 512 latches the print data SI stored in the shift register 511 as parallel data based on a latch signal LT from the print head driver 65.

The level shifter 513 converts the latched output from the latch circuit 512 to the voltage required by the selection switch 514 described below.

One node of the actuator $AC_i$ goes to ground, and the selection switch 514 selects whether to supply the drive signal COM to the other node of the actuator $AC_i$. The selection switch 514 is an analog switch rendered by a transmission gate of p-channel FET (field effect transistor) and n-channel FET devices not shown.

When a voltage converted by the level shifter 513 is input as a gate voltage, the analog switch operates to supply the drive signal COM output from the drive signal generator 651 to the actuator $AC_i$.

When the bitmap data for printing the barcode 83 is input to the control unit 63 of this printer 1, the CPU 73 converts the input bitmap data to converted bitmap data that is used as the new bitmap data. For this conversion, the CPU 73 shifts the data in columns 4 to 6 of the bitmap data shown in FIG. 4C one bit in the line (X-axis) direction, and shifts the bits in columns 7 to 9 two bits in the line (X-axis) direction, resulting in the converted bitmap data shown in FIG. 6A.

Figures 6A, 6B:
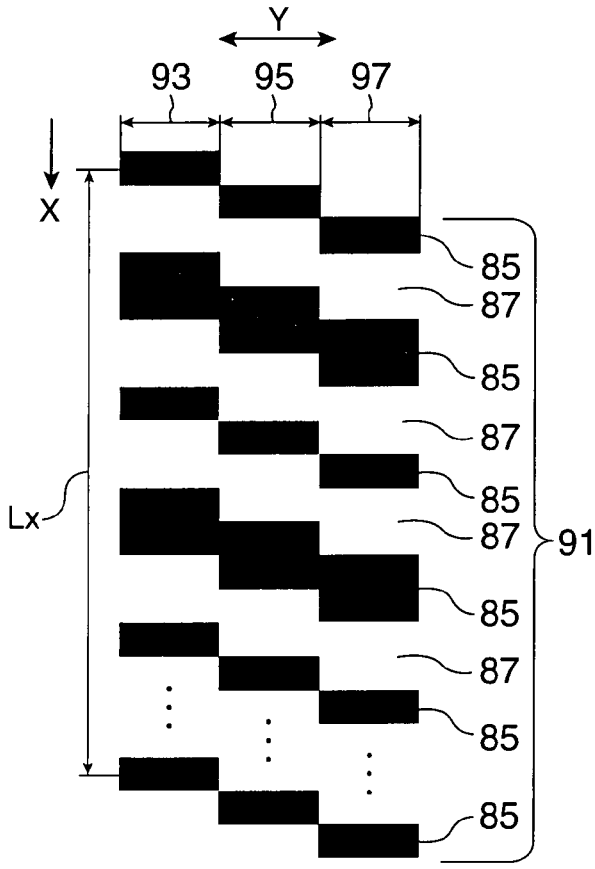
FIGS. 6A and 6B describe the converted bitmap data of the printer according to the preferred embodiment of the invention.

When the barcode is printed using this converted bitmap data, the bars 85 and spaces 87 in the resulting barcode 91 are staggered in steps as shown in FIG. 6B. More specifically, this converted bitmap data divides the Y-axis or length of the bars 85 of barcode 83 shown in FIG. 4A into a first segment 93, a second segment 95, and a third segment 97, and changes the print nozzles used for printing the first segment 93, second segment 95, and third segment 97.

Note that the converted bitmap data shown in FIG. 6A has more than 180 lines in columns 4 to 9. In this case printing the barcode 83 is divided into two parts with the first part printing the portion of the barcode exceeding 180 lines and the second part printing the portion through line 180.

Printing the barcode 91 based on this converted bitmap data is described next with reference to the flow of data and signals.

When the bitmap data shown in FIG. 4C is stored in the SDRAM 75 of the printer 1, the CPU 73 reads the bitmap data, converts the read bitmap data to the converted bitmap data shown in FIG. 6A, and stores the converted bitmap data in the SDRAM 75.

The CPU 73 then reads the converted bitmap data BM stored in the SDRAM 75 and the waveform data WD stored in ROM 79.

The CPU 73 then outputs a carriage drive command to the carriage motor driver 69 to start driving the carriage motor 31 so that the print head 5 moves across the print medium P on the Y-axis.

The CPU 73 then sends the read converted bitmap data BM and waveform data WD with an actuator drive command OC to the print head driver 65 as shown in FIG. 5.

After receiving the actuator drive command OC, the print head driver 65 converts the converted bitmap data BM to print data SI, and outputs the print data SI with the clock signal SCK to the shift register 511.

When storing of the print data SI to the shift register 511 ends, the print head driver 65 outputs the latch signal LT to cause the latch circuit 512 to latch the print data SI.

The latched print data SI is then converted by the level shifter 513 to a gate voltage and supplied to an analog switch (not shown) of the selection switch 514.

The drive signal COM supplied from the drive signal generator 651 to the selection switch 514 is then supplied through the analog switch to which the gate voltage is applied to the actuator $AC_i$, and an ink droplet is discharged.

One column of the converted bitmap data BM is thus printed. While the print head 5 traverses the print medium P in the Y-axis direction, the operation of converting the converted bitmap data BM to print data SI and driving the actuator $AC_i$ repeats at the interval corresponding to the print resolution along the Y-axis, and the barcode 91 shown in FIG. 6B is thus printed.

The CPU 73 in this embodiment of the invention corresponds to the data conversion means of the accompanying claims, the head carriage mechanism 7 corresponds to the relative motion means, and the print head driver 65 corresponds to the discharge control means.

The printer 1 according to this embodiment of the invention divides the length or Y-axis dimension of the bars 85 and spaces 87 in the barcode 83 to be printed into a first segment 93, a second segment 95, and a third segment 97, and shifts the print nozzles of the nozzles $N_i$ in the nozzle row 17 that is aligned with the X-axis along the X-axis to print the barcode 91.

Figure 7A:
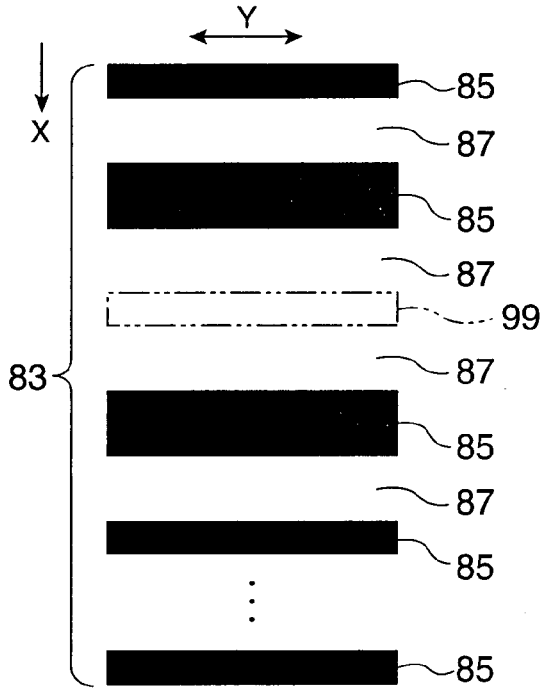
FIGS. 7A-7C describe the effect of the invention.
Figure 7B:
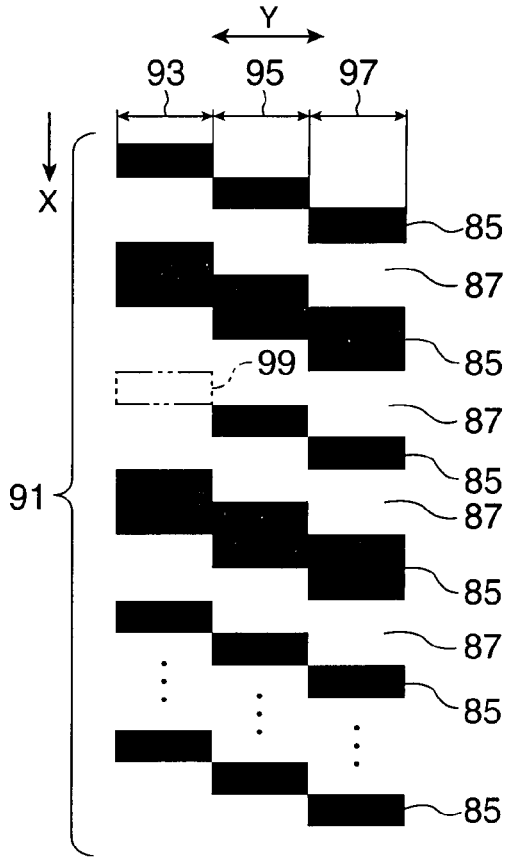

If some problem renders the nozzle $N_8$ corresponding to line 8 of the bitmap data shown in FIG. 4C unable to print and the barcode defined by the bitmap data shown in FIG. 4C is to be printed, the bar 99 that should be printed by nozzle $N_8$ will not be printed as shown in FIG. 7A. While the bar 99 to be printed in the first segment 93 by nozzle $N_8$ is therefore not printed, bars 85 are printed in the second segment 95 and third segment 97 of the barcode printed by the printer 1 of the invention as shown in FIG. 7B.

When this barcode 91 is then read by a barcode reader, a read error occurs when reading the first segment 93, but the barcode 91 can be correctly read in the second segment 95 and third segment 97.

This embodiment of the invention can print a barcode 91 so that the bars 85 and spaces 87 shift downstream on the X-axis in the first segment 93, second segment 95, and third segment 97. More specifically as shown in FIG. 7B, the bars 85 in the second segment 95 are shifted downstream on the X-axis from the bars 85 in the first segment 93, and the bars 85 in the third segment 97 are shifted downstream on the X-axis from the bars 85 in the second segment 95 of the barcode 91 printed by the printer 1. Compared with shifting randomly with no specific pattern, the segments 93, 95, and 97 can be readily discerned visually, and the barcode reader can be easily aligned with each of the segments 93, 95, and 97. Less time and effort is therefore required to accurately read the barcode 91.

Figure 7C:
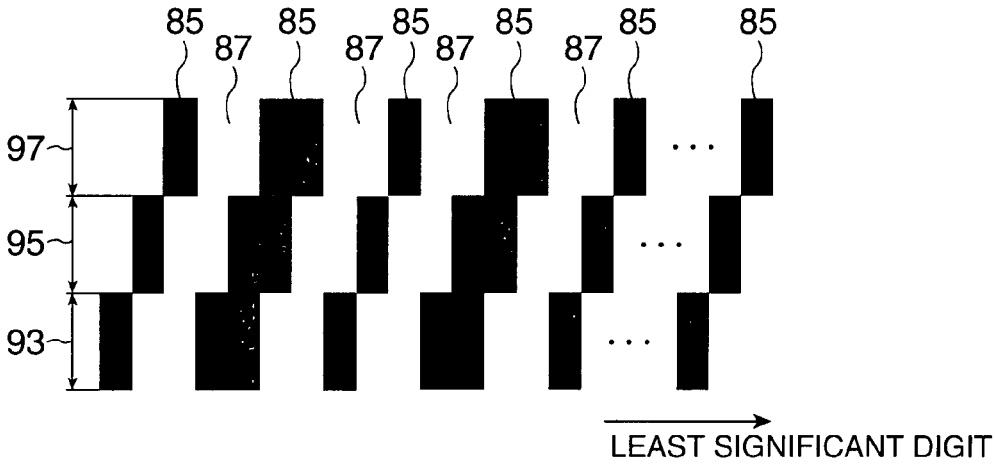

By shifting the bars 85 having regular spacing and width requirements towards the least significant digit of the information represented by the barcode 91 when the barcode 91 is seen from the front as shown in FIG. 7C, the starting position of the information in the barcode 91 can be easily determined visually and the barcode reader can be easily aligned with each of the segments 93, 95, and 97.

This embodiment converts the bitmap data shown in FIG. 4C to the converted bitmap data in which each data column is shifted one line in each of the segments 93, 95, and 97. In other words, the nozzles $N_i$ immediately adjacent to the print nozzles of the nozzle row 17 in the first segment 93 become the print nozzles in the second segment 95, and the nozzles $N_i$ immediately adjacent to the print nozzles in the second segment 95 become the print nozzles in the third segment 97.

The offset between the bars 85 is therefore the same in each of the segments 93, 95, and 97, and the segments 93, 95, and 97 of the barcode 91 can be easily visually determined. The barcode reader can therefore be easily aligned with the desired segment 93, 95, or 97.

In addition, the offset in the x-direction between the bars 85 in each of the segments 93, 95, and 97 can be made equal to the gap between the nozzles $N_i$ of the nozzle row 17, that is, the print resolution on the X-axis. The likelihood of being able to correctly read the information in the barcode 91 can therefore be improved by moving the barcode reader only on the Y-axis in each of the segments 93, 95, and 97 and not on the X-axis.

This embodiment of the invention converts the bitmap data to the converted bitmap data before printing starts. This simplifies the printing process, reduces the time required for printing, and reduces the processing load on the CPU compared with shifting the bars 85 and spaces 87 when converting the bitmap data to the print data SI.

This embodiment of the invention divides the barcode 91 along the length of the bars 85 into three parts denoted the first segment 93, second segment 95, and third segment 97 above, but the number of parts (segments) is not so limited and can be any number of two or more.

This embodiment also shifts the bars 85 and spaces 87 of the barcode 91 a distance equivalent to one nozzle $N_i$ of the nozzle row 17 in the same direction on the X-axis in the first segment 93, the second segment 95, and the third segment 97, but the direction and distance of this shift is not so limited and the direction and distance of the shift can be determined as desired.

The CPU 73 of the printer 1 in this embodiment of the invention converts the bitmap data received from the host computer 81 to the converted bitmap data, but the invention is not so limited. More particularly, the host computer 81 can convert the bitmap data to the converted bitmap data to eliminate the time and processing required for conversion by the printer 1 and therefore reduce the load on the CPU 73.

The power transfer mechanism from the paper feed motor 21 to the paper feed roller 19*a* can include the first, second, and third gears 23, 24, and 25 in this embodiment of the invention, but the power transfer mechanism is not so limited. A transfer belt mechanism using pulleys and a timing belt, or other suitably arranged power transfer mechanism can be used instead.

The paper feed motor 21 and carriage motor 31 are also not limited to stepping motors, and could be a DC motor, for example.

The print head 5 is arranged with the nozzle row 17 aligned with the X-axis in this embodiment, but the invention is not so limited and the nozzle row 17 could be oriented to intersect the X-axis at a desired angle. This effectively reduces the nozzle pitch relative to the Y-axis and therefore improves the print resolution on the X-axis.

The number of nozzles $N_i$ in the nozzle row 17 is also not limited to 180 and can be any number of plural nozzles $N_i$.

The print medium P is also not limited to roll paper and could be cut-sheet paper instead.

The print medium is also not limited to paper P, and any desired print medium to which ink droplets will adhere to form dots can be used.

Furthermore, the embodiment is described using a serial printer that prints while moving the print head 5 bidirectionally along the Y-axis, but the invention is not so limited. For example, the invention can be used with a line printer that uses a print head having a nozzle array that is equal in length to the print medium P and has the print head disposed so that the nozzle array spans the print medium P on the Y-axis so that the printer can print without moving the print head.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printing method for printing a barcode by discharging ink droplets from print nozzles that are used for printing bars in the barcode, the printing method comprising:

dividing the length of the bars of the barcode into a plurality of segments;

changing which of the plurality of nozzles are used as print nozzles in each segment, such that a portion of the plurality of print nozzles that is not all of the plurality of print nozzles are reassigned so that a portion of bars in a first segment are shifted a predetermined direction relative to a portion of bars in a second segment; and printing the barcode by discharging the ink droplets from the print nozzles in each segment.

2. The printing method described in claim 1, wherein the predetermined direction is towards the least significant digit of the information represented by the barcode when the barcode is seen from the front.

3. The printing method described in claim 1, wherein in said changing step, the portion of the plurality of nozzles that are reassigned are offset a predetermined number of nozzles from print nozzles of the first segment and are assigned as new print nozzles for the second segment.

4. The printing method described in claim 3, wherein the predetermined number of nozzles is one.

5. The printing method described in claim 3, wherein the predetermined number of nozzles is the same for each of said plurality of segments.

6. The printing method described in claim 1, wherein a number of said plurality of segments equals 3.

* * * * *